US010569240B2

(12) United States Patent
Casey

(10) Patent No.: US 10,569,240 B2
(45) Date of Patent: Feb. 25, 2020

(54) CONTAINER SYSTEM WITH MIXING BLADE

(71) Applicant: DryBev International, Inc., Charlestown (KN)

(72) Inventor: Theodore Casey, Dallas, TX (US)

(73) Assignee: DryBev International, Inc., Charlestown (KN)

( * ) Notice: Subject to any disclaimer, the term of this patent is extended or adjusted under 35 U.S.C. 154(b) by 608 days.

(21) Appl. No.: 14/593,763

(22) Filed: Jan. 9, 2015

(65) Prior Publication Data

US 2016/0199801 A1 Jul. 14, 2016

(51) Int. Cl.

| | |
|---|---|
| ***B01F 11/00*** | (2006.01) |
| ***B65D 81/32*** | (2006.01) |
| ***B01F 13/00*** | (2006.01) |
| ***B01F 15/00*** | (2006.01) |
| ***B01F 15/02*** | (2006.01) |
| ***B01F 3/12*** | (2006.01) |

(52) U.S. Cl.

CPC ..... *B01F 11/0005* (2013.01); *B01F 3/12* (2013.01); *B01F 13/0022* (2013.01); *B01F 15/00512* (2013.01); *B01F 15/0215* (2013.01); *B01F 15/0224* (2013.01); *B65D 81/3222* (2013.01)

(58) Field of Classification Search

CPC ..... B01F 11/0011; B01F 11/0005; B01F 3/12; B01F 13/0022; B01F 15/00512; B01F 15/0215; B01F 15/0224; B65D 81/3222

USPC ..... 366/130

See application file for complete search history.

(56) References Cited

U.S. PATENT DOCUMENTS

| | | | |
|---|---|---|---|
| 937,049 | A | 10/1909 | Callahan |
| 1,661,336 | A | 3/1928 | Katz |
| 1,966,611 | A | 7/1934 | Cobel |
| 2,433,248 | A | 12/1947 | Sweier, Jr. |
| 3,220,588 | A | 11/1965 | Lipari |

(Continued)

FOREIGN PATENT DOCUMENTS

| | | | |
|---|---|---|---|
| EP | 0190593 | A2 | 8/1986 |
| WO | 2008096261 | A1 | 8/2008 |

OTHER PUBLICATIONS

PCT International Search Report for related PCT/US16/41558, dated Nov. 7, 2016, 5 pages.

(Continued)

*Primary Examiner* — Anshu Bhatia

(74) *Attorney, Agent, or Firm* — Griffith Barbee PLLC

(57) ABSTRACT

A container system for separately storing and mixing two or more substances. The container system comprises a mixing container having a main container that stores one or more first substances. The main container has a first upper opening. The container system also includes a storage repository coupled to main container, and which stores one or more second substances. The storage repository includes a lip defining a second upper opening, which has an outside diameter smaller than the diameter of the first upper opening. Additionally, the container system includes a mixing blade having an outside diameter smaller than the diameter of the first upper opening. The mixing blade also has a plurality of openings. The container system includes a releasable liner placed over the storage repository's lip, and the storage repository's lip forms a seal with a lower surface of the releasable liner.

3 Claims, 8 Drawing Sheets

(56) References Cited

U.S. PATENT DOCUMENTS 3,613,955 A 10/1971 Wetherell, Jr.
3,924,741 A * 12/1975 Kachur ..... B65D 51/2892 206/221
4,193,698 A 3/1980 Gartner
4,272,199 A 6/1981 Hade
4,819,819 A * 4/1989 Robertson, Jr. ..... B65D 47/103 215/230
5,114,011 A 5/1992 Robbins, III
5,735,320 A 4/1998 Tune et al.
5,950,819 A 9/1999 Sellars
6,047,818 A 4/2000 Warby et al.
6,059,443 A * 5/2000 Casey ..... A45F 3/16 206/219
6,152,296 A * 11/2000 Shih ..... B65D 51/2835 206/222
6,257,428 B1 7/2001 Caola
6,379,032 B1 4/2002 Sorensen
6,527,110 B2 3/2003 Moscovitz
6,616,319 B2 * 9/2003 Renz ..... A61J 9/00 215/11.1
6,854,595 B2 * 2/2005 Kiser ..... B65D 51/2878 206/219
6,935,493 B2 8/2005 Cho
7,055,685 B1 6/2006 Patterson et al.
7,503,453 B2 3/2009 Cronin et al.
7,523,823 B1 4/2009 Bednar
7,568,576 B2 * 8/2009 Sweeney, Jr. ..... B65D 51/2864 206/219
7,588,142 B1 9/2009 Bush
7,823,723 B2 * 11/2010 Anthony ..... B65D 5/748 206/219
7,861,855 B2 * 1/2011 Casey ..... B65D 81/3283 206/221
7,900,787 B2 3/2011 Oh et al.
8,523,837 B2 * 9/2013 Wiggins ..... B65D 51/225 206/221
8,701,906 B1 * 4/2014 Anderson ..... B65D 41/20 206/220
8,720,680 B2 5/2014 Casey
8,757,408 B2 * 6/2014 Joubert ..... B65D 23/085 215/227
8,801,688 B2 * 8/2014 Wiggins ..... B65D 51/225 604/403
8,834,449 B2 9/2014 Machan et al.
8,960,424 B1 2/2015 Anderson
9,242,772 B1 * 1/2016 Anderson ..... B65D 51/2835
9,248,423 B2 2/2016 Cerasani
2002/0118595 A1 * 8/2002 Miller ..... A61L 24/06 366/130
2002/0179461 A1 * 12/2002 Mollstam ..... B65D 47/2031 206/222
2003/0213709 A1 * 11/2003 Gibler ..... B65D 51/2842 206/219
2004/0149599 A1 * 8/2004 Cho ..... B65D 51/2892 206/219
2004/0200741 A1 * 10/2004 Cho ..... B65D 51/2864 206/219
2006/0283726 A1 12/2006 McCloud
2007/0045134 A1 * 3/2007 Dvorak ..... B65D 51/2835 206/222
2007/0227919 A1 10/2007 True
2008/0156674 A1 7/2008 Correale et al.
2008/0202950 A1 8/2008 Anderson
2010/0108715 A1 5/2010 Santagiuliana
2012/0204578 A1 8/2012 Leavitt et al.
2015/0016208 A1 1/2015 Larson et al.

OTHER PUBLICATIONS

PCT Written Opinion of the International Search Authority for related PCT/US16/41558, dated Nov. 7, 2016, 6 pages.
Machine Translation dated Aug. 31, 2016, CN 102126288B, published May 7, 2014, 6 pages.
Machine Translation of Abstract EP0190593, obtained from Espacenet on Nov. 30, 2016, 2 pages.

* cited by examiner

CONTAINER SYSTEM WITH MIXING BLADE

TECHNICAL FIELD

Disclosed herein is a method and system for separately storing and mixing two or more substances.

DESCRIPTION OF RELATED ART

There exist prior art systems for separately storing and mixing two or more substances. Examples include the systems described in U.S. Pat. Nos. 6,059,443, 7,861,855 B2, 8,720,680 B2, and European Patent No. EP 2190751B1, the disclosures of which are incorporated by reference. Disclosed herein is an improved method and system for separately storing and mixing two or more substances.

SUMMARY OF THE DISCLOSURE

In one aspect, what is disclosed herein is a container system. The container system includes a mixing container having a main container that stores one or more first substances. The main container has a first upper opening. The container system also includes a storage repository coupled to main container, and which stores one or more second substances. The storage repository includes a lip defining a second upper opening, which has an outside diameter smaller than the diameter of the first upper opening. Additionally, the container system includes a mixing blade having an outside diameter smaller than the diameter of the first upper opening and an inside diameter smaller than the outside diameter of the storage repository's lip. The mixing blade also has a plurality of openings. Furthermore, the container system includes a releasable liner placed over the storage repository's lip, and the storage repository's lip forms a seal with a lower surface of the releasable liner.

In another aspect, presently disclosed is a method of separately storing one or more first substances and one or more second substances, and mixing the substances at the time of usage of a product comprising a mixture of the substances. The method involves agitating the container system after removal of the releasable liner so that the one or more first substances and one or more second substances are permitted to mix with another.

BRIEF DESCRIPTION OF THE DRAWINGS

The disclosure will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
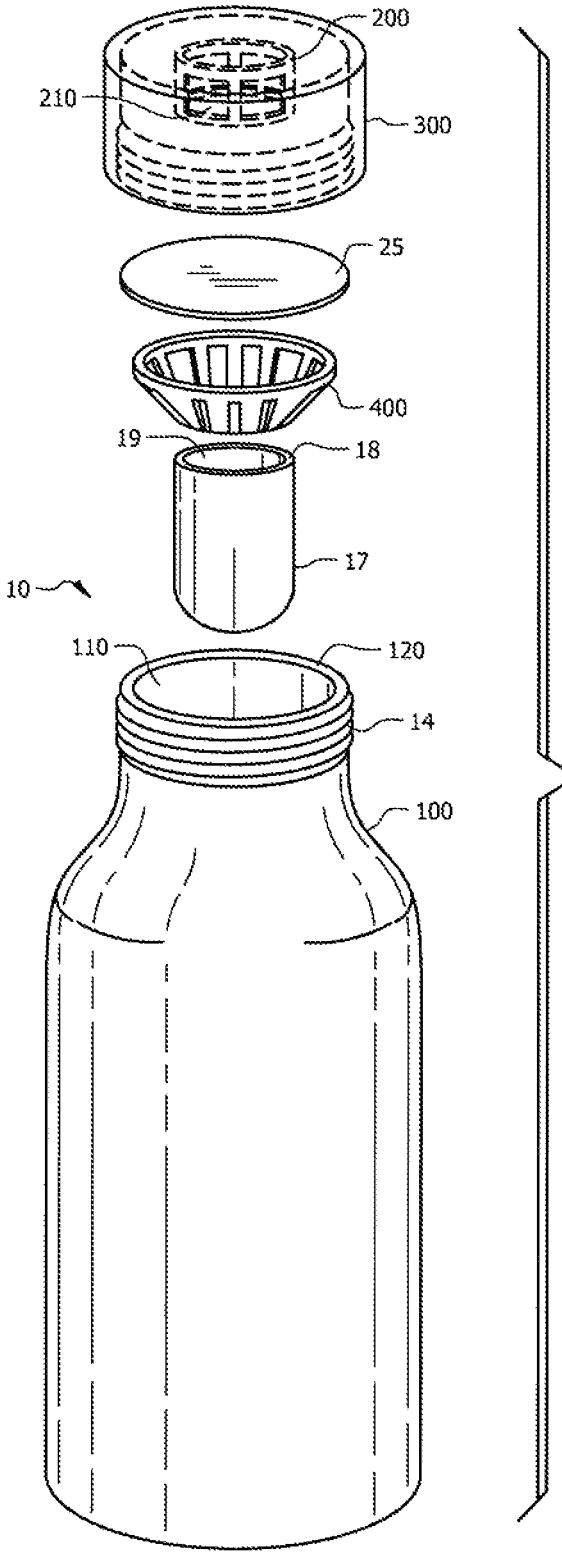
FIG. 1 is an exploded perspective view of a preferred embodiment of the container system of the present disclosure.

Referring to FIGS. 1-7, a preferred storage and mixing container 10 comprises a bottle 100 for containing one or more first substances, such as a liquid 33, a storage repository 17 for containing one or more second substances, such as a powder 35. The storage repository 17 is disposed within an upper opening 110 of the bottle 100 and coupled to the neck 120 of the bottle 100. This preferred embodiment includes a releasable liner 25 to cover a second upper opening 19 of the storage repository 17 when the container 10 is used to separately store the powder 35 from the liquid 33, and a cap 300 including a mixing blade 200 that couples to the bottle 100, such as by threads 14.

As depicted in FIGS. 1-3 and FIGS. 5-6, the cap 300 may comprise an element 200, sometimes referred to as a mixing blade, which is generally centrally located within the interior of the cap 300. As shown, the element 200 may be generally ring-shaped and have substantially the same diameter as the lip 18 defining an upper opening to the storage repository 17. Further, the element 200 may comprise ports 210 through the walls thereof. One of ordinary skill in the art will appreciate element 200 can be implemented in shapes other than circular shapes, such as a square, rectangle, pentagon, and the like; if non-circular shapes are used for element 200, lip 18 should be formed so that it generally matches the non-circular shape of and has the same perimeter as element 200.

Figure 1A:
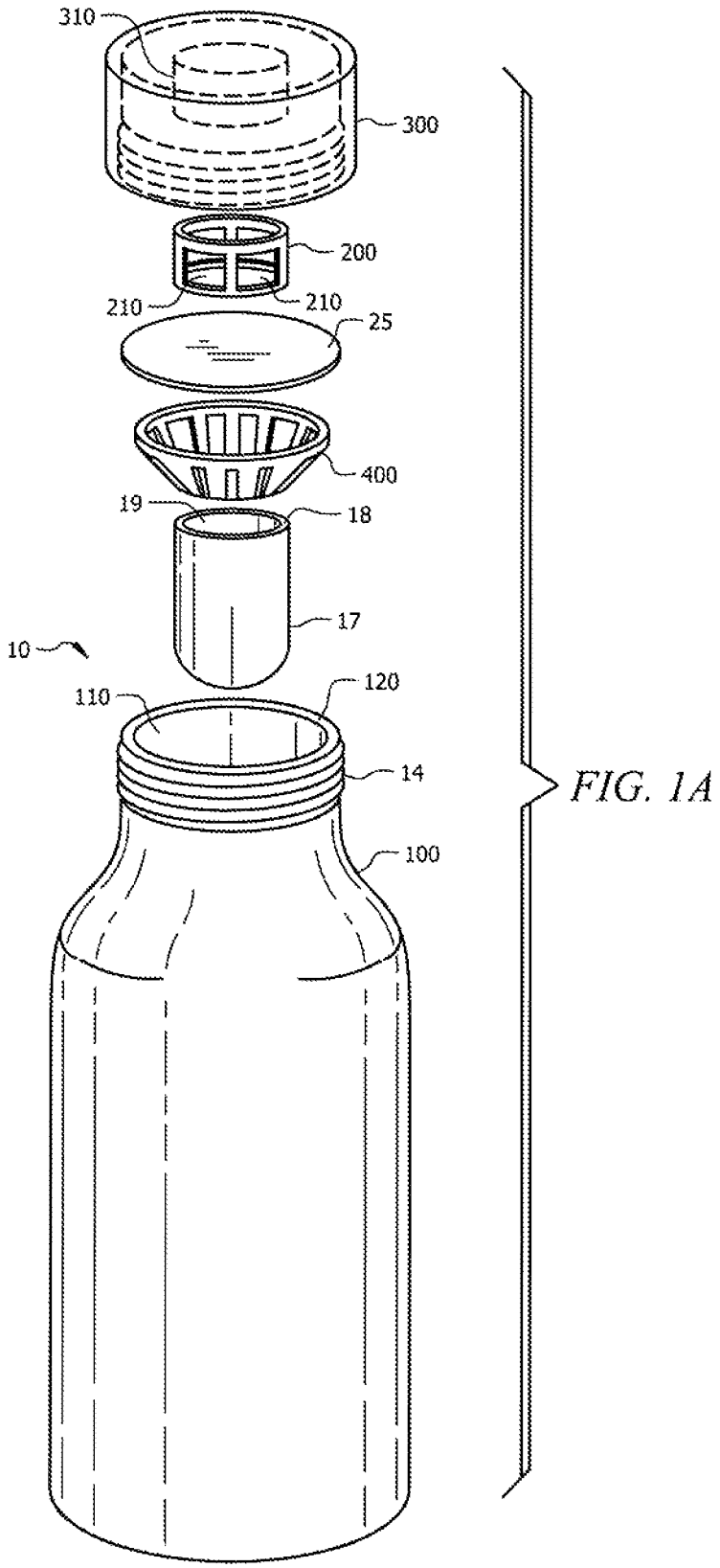
FIG. 1A is an exploded perspective view of an alternative embodiment of the container system of the present disclosure.
Figure 2:
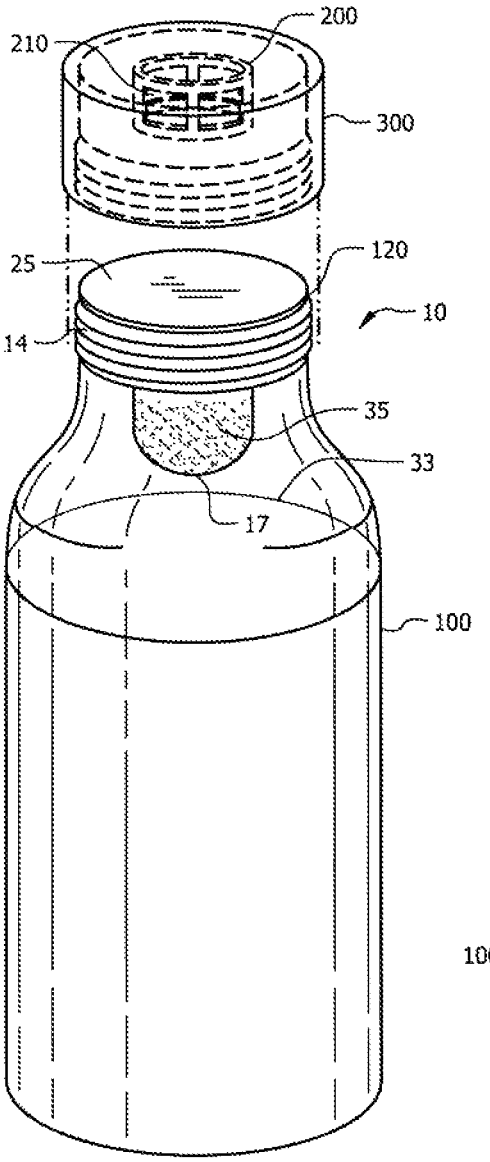
FIG. 2 is a perspective view of a preferred embodiment of the container system of the present disclosure with the storage repository covered by a releasable liner.
Figure 3:
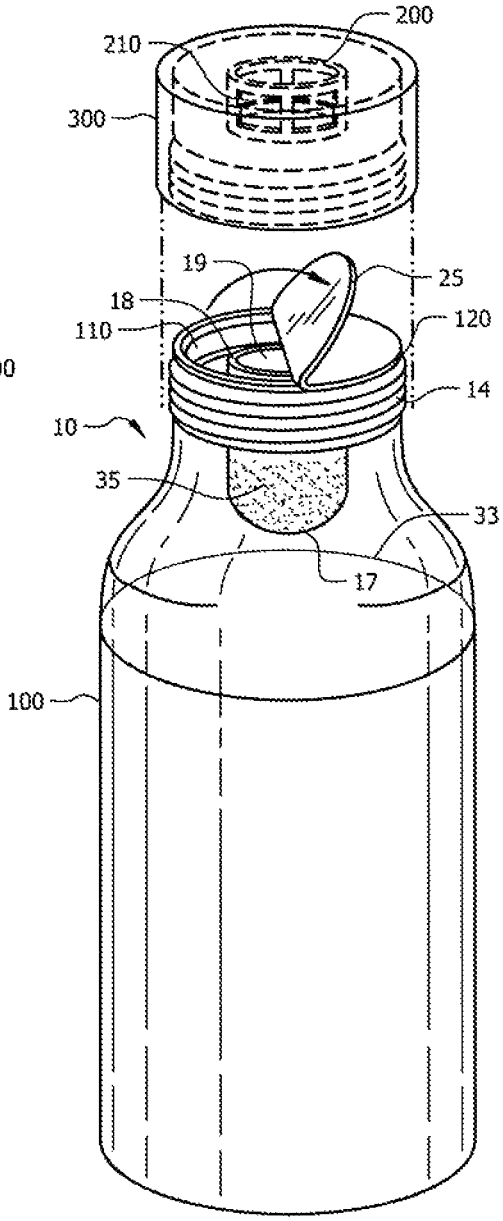
FIG. 3 is a perspective view of a preferred embodiment of the container system of the present disclosure showing the releasable liner being released.
Figure 4:
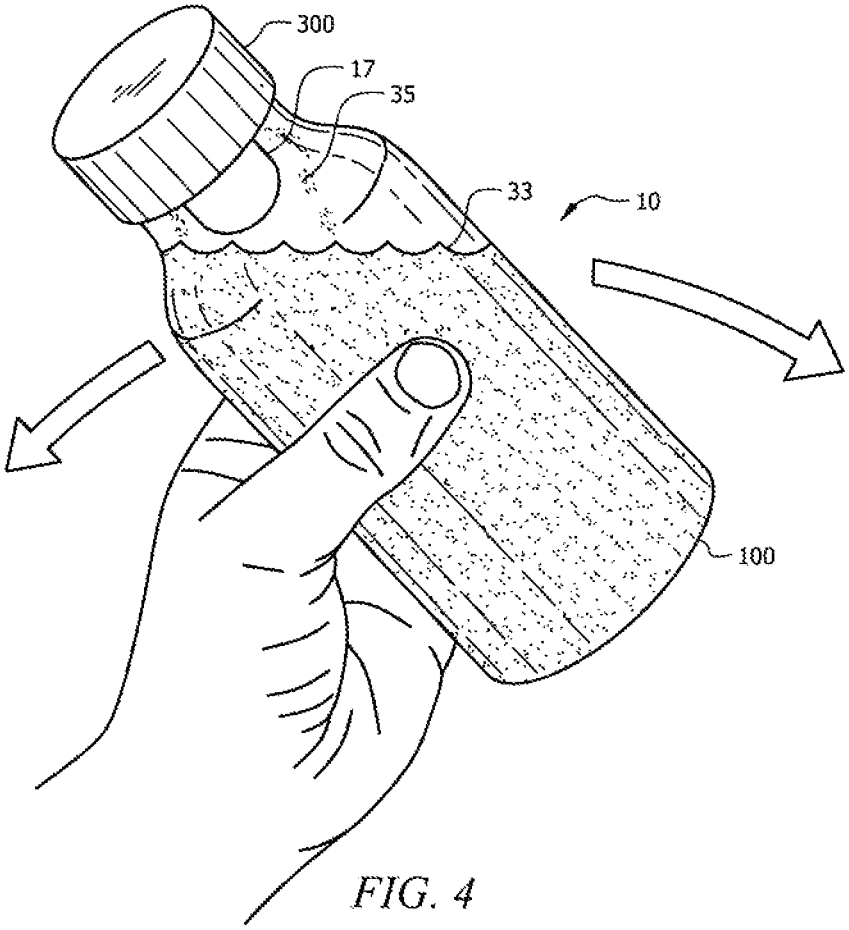
FIG. 4 is a view of the container system showing the container system being agitated so that the one or more first substances and one or more second substances are mixed.
Figure 5:
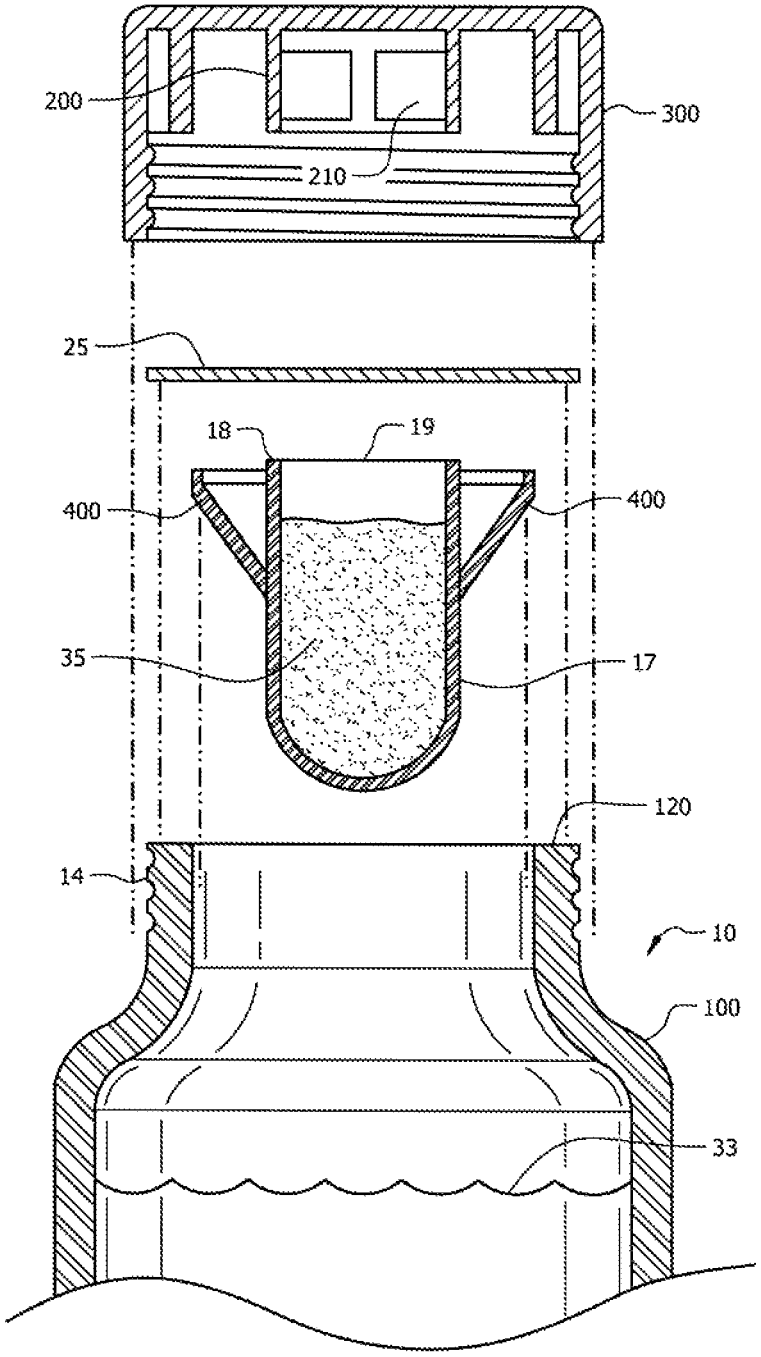
FIG. 5 is an exploded, front elevational, cross-sectional view of a preferred embodiment of the container system of the present disclosure.

In various implementations, the element 200 may be formed integrally within the cap 300, as shown in FIG. 1, or the element 200 may be formed separately from the cap 300 and secured within a ring 310 disposed in cap 300, as shown in FIG. 1A. In the implementation of FIG. 1A, the element 200 may be secured within the ring 310 via interference fit and/or otherwise coupled to the cap 300 adhesively, mechanically, magnetically or by other means that will be apparent to one of ordinary skill in the art.

As depicted in FIGS. 1 and 1A, the container system includes one or more couplings 400 used so that the storage repository 17 will be disposed within an upper opening of the bottle 100 and coupled to the neck 120 of the bottle 100. Disposition of the storage repository 17 within the bottle 100 is depicted in FIGS. 6 and 7.

Figure 6:
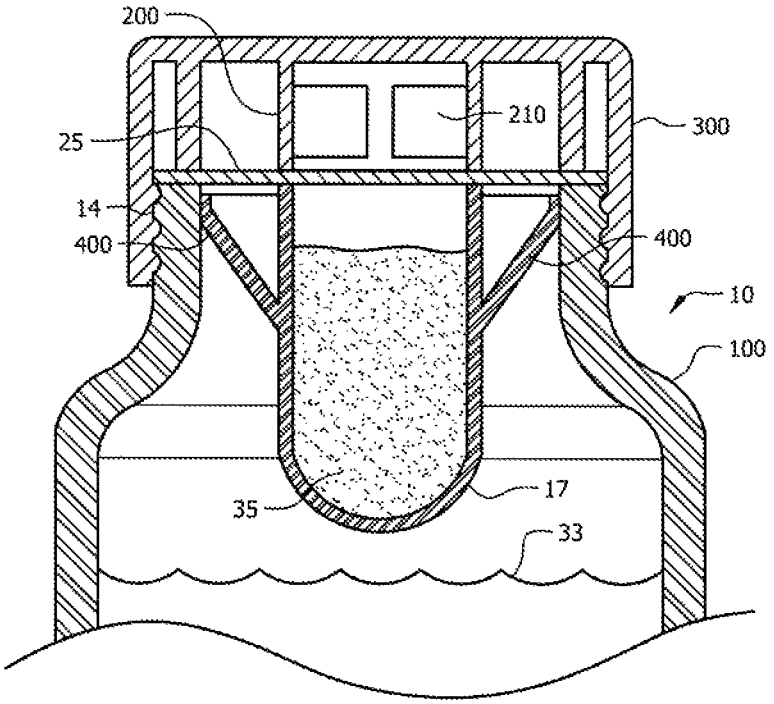
FIG. 6 is a front elevational, cross-sectional view of a preferred embodiment of the container system of the present disclosure with the releasable liner placed over the storage repository.

As depicted in FIG. 6, when the cap 300 is coupled to the bottle 100 while the releasable liner 25 is present, and the mixing blade 200 is contacting an upper surface of the releasable liner 25, a seal is formed between a lower surface of the releasable liner 25 and the lip 18 of the storage repository 17. The seal prevents the one or more first substances 33 from mixing with the one or more second substances 35. As shown in FIG. 6, the cap 300 is coupled to the bottle 100 using threads, but one of ordinary skill in the art will appreciate any number of other means can be used to couple cap 300 to bottle 100.

Figure 7:
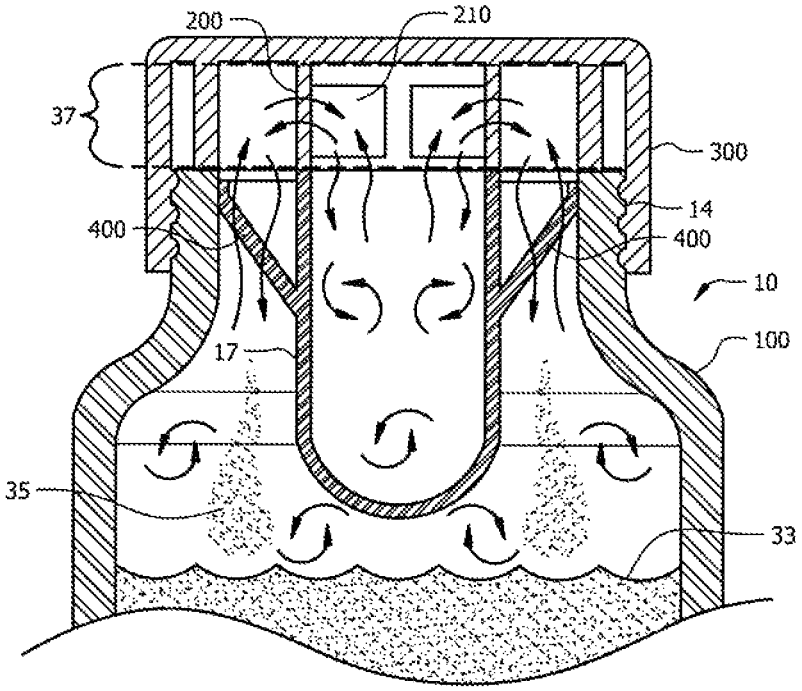
FIG. 7 is a front elevational, cross-sectional view of a preferred embodiment of the container system of the present disclosure with the releasable liner removed.

FIG. 7 depicts the container system when the releasable liner 25 has been removed. A gap 37 is provided, comprising space above the one or more couplings, continuing above the upper opening 110 of the bottle 100, and below an interior surface of the top of the cap 300, through ports 210, and into additional open space inside mixing blade 200. The gap 37 provides additional space to facilitate mixing of liquid 33 and powder 35. When releasable liner 25 has been removed, liquid 33 may move between the bottle 100, gap 37, and storage repository 17 by passing through the one or more couplings 400 and ports 210 of the mixing blade 200. Likewise, when releasable liner 25 has been removed, powder 35 may move between the storage repository 17, gap 37, and the bottle 100 by passing through ports 210 of the mixing blade 200 and the one or more couplings 400. Such mixing is depicted in FIG. 7, and occurs when, for example, the bottle 100 is shaken, inverted, or otherwise agitated, one example of such agitation being depicted in FIG. 4.

In a preferred embodiment, as depicted in FIGS. 6 and 7, mixing blade 200 may have substantially the same height as the height of the space created between the upper opening 110 of the bottle 100 and the interior surface of the top of the cap 300, and the diameter of the mixing blade may have substantially the same diameter as the diameter of the lip 18 of the storage repository 17. One of ordinary skill in the art will appreciate that mixing blade 200 can be designed with ports 210 having virtually any shape, including polygonal shapes such as rectangles, squares, and triangles, or curved shapes, such as circles. Also, the number of ports 210 that may be used is not limited to the number depicted in FIGS. 1-3.

Figure 8A:
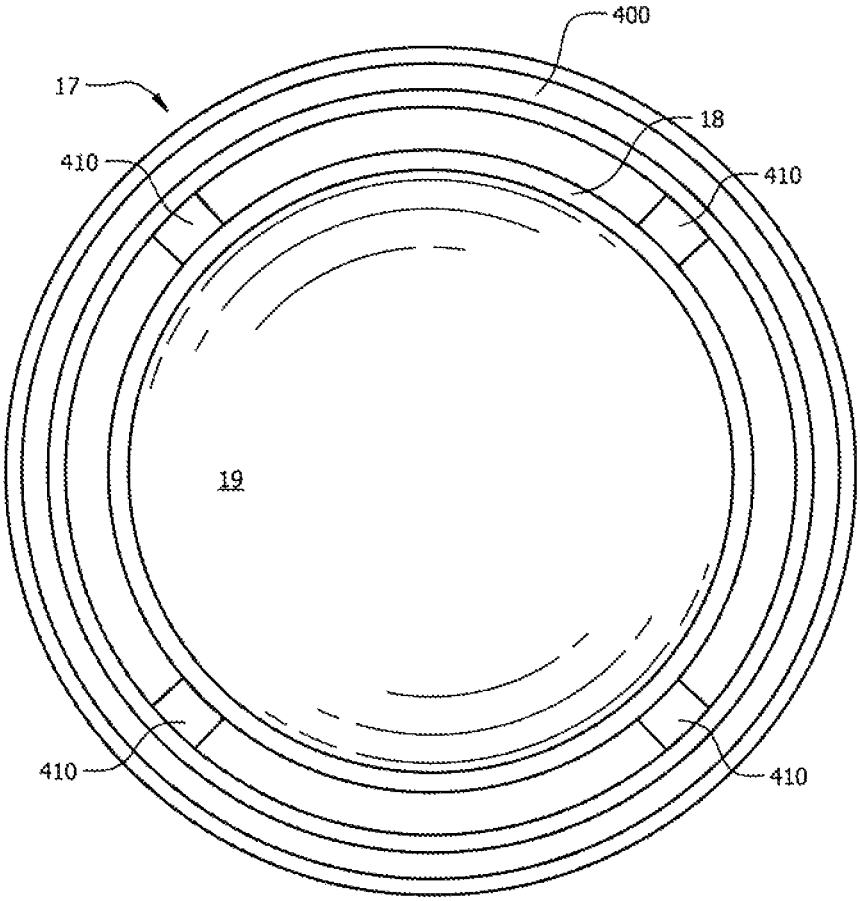
FIG. 8A is a top, or overhead, view of the storage repository of a preferred embodiment of the container system of the present disclosure.
Figure 8B:
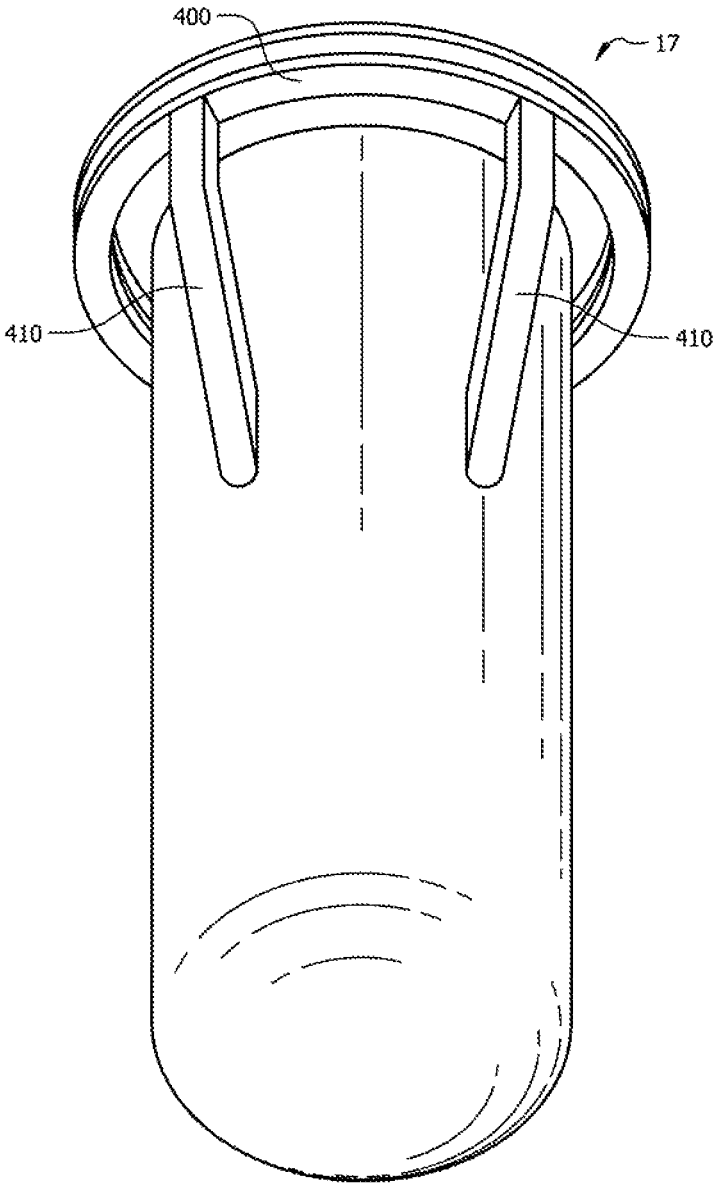
FIG. 8B is a perspective view of the storage repository of a preferred embodiment of the container system of the present disclosure.

While the one or more couplings 400 may not be designed so that the one or more first substances and one or more second substances are completely prevented from moving between the bottle 100 and storage repository 17, one of ordinary skill in the art will appreciate that various couplings may be used to couple the storage repository 17 to the neck 110 of bottle 100. Couplings 400 may consist of a single piece of material having ports through which the one or more first and second substances may move, or, as depicted in FIGS. 8A and 8B, multiple pieces of material, such as support arms 410, that are placed apart from one another to create space through which the one or more first and second substances may move. Also, couplings 400 may be manufactured as one piece with the storage repository 17 or bottle 100, or may be separate components.

The one or more first substances and the one or more second substances may each be in solid form, liquid form, or some combination thereof. Examples of substances that may be used in connection with the container system include but are not limited to the following substances: water, dehydrated substances, preservative free substances, dietary supplement mixtures, nutritional mixtures, protein mixtures, dairy based proteins, milk proteins, whey proteins, vegetable based proteins, soy based proteins, amino-acids, beta alanine, vitamins, minerals, creatine, glutamine, L-arginine, phenylalanine, L-Leucine, L-Isoleucine, L-yaline, synephrine, yohimbe, ginseng, ascorbic acid, hydroxyl citric acid, aloe vera, dimethylamyamine, polysaccharide, monosaccharide, maltodextrin, dextrose, fructose, silicon, artificial sweeteners, natural sweeteners, sucralose, artificial or natural flavors, artificial or natural colors, tea, coffee, dairy product, or any other substances which may be consumed by a user either alone, or in combination with any other chemical or other substance.

The bottle 100 and storage repository 17 may be constructed of any material suitable for storing liquid or solid substances. In a preferred embodiment, the bottle 100 is manufactured of polyethylene terephthalate (PET). One of ordinary skill in the art will appreciate that other materials also could be used to manufacture said bottle 100 or storage repository 17, such as other plastics (including High Density Polyethylene and polypropylene), glass, metal, styrofoam and the like. It is contemplated that alternate embodiments of the container system may be constructed of materials suitable for heating within a microwave oven or other heating apparatus. Cap 300, mixing blade 200, and the one or more couplings 400 may likewise be constructed of any suitable materials, including those identified above.

The purpose of releasable liner 25 is to prevent the mixing of the one or more first substances and the one or more second substances. One of ordinary skill in the art will therefore appreciate releasable liner 25 can be implemented in the container system of the present disclosure in many different ways. Releasable liner 25 may cover first upper opening 110 of the bottle 100 and the second upper opening 19 of storage repository 17, but one of ordinary skill in the art will appreciate releasable liner 25 need only cover second upper opening 19. Releasable liner 25 may be a gasket, i.e., it may be loosely placed over second upper opening 19 in the absence of cap 300 being placed on bottle 100, so that the releasable liner 25 might fall off when cap 300 is removed. Or, releasable liner 25 might be coupled to bottle 100 and/or lip 18 using an adhesive. Releasable liner 25 could even be formed in the shape of a sphere, such as a marble, or a spherical cone, and be disposed in second upper opening 19 of storage repository 17.

It is believed the operation and construction of the apparatus and method disclosed herein will be apparent from the foregoing description. While the apparatus and method shown and described has been characterized as being preferred, it will be readily apparent that various changes and modifications could be made without departing from the spirit and scope of the disclosure.

The invention claimed is:

1. A method for separately storing and mixing two or more substances in a container system, the method comprising:

(a) holding one or more first substances in a main container;

(b) holding one or more second substances in a storage repository coupled within said main container;

(c) closing said storage repository with a liner to prevent said second substances from mixing with said first substances;

(d) engaging said liner with a mixing blade to aid in sealing said repository closed; and (e) when mixing of said first substances with said second substances is desired:

disengaging said mixing blade from said liner;

releasing said liner to open said storage repository;

closing said main container with a cap coupled to said mixing blade; and shaking said container system to cause mixing of said first substances with said second substances, wherein said mixing blade aids in said mixing step.

2. The method of claim 1, wherein said one or more first substances are selected from the group comprising: water, dehydrated substances, preservatives, preservative free substances, dietary supplement mixtures, nutritional mixtures, protein mixtures, dairy based proteins, milk proteins, whey proteins, vegetable based proteins, soy based proteins, amino-acids, beta alanine, vitamins, minerals, creatine, glutamine, L-arginine, phenylalanine, L-Leucine, L-Isoleucine, L-yaline, synephrine, yohimbe, ginseng, ascorbic acid, hydroxyl citric acid, aloe vera, dimethylamyamine, polysaccharide, monosaccharide, maltodextrin, dextrose, fructose, silicon, artificial sweeteners, natural sweeteners, sucralose, artificial or natural flavors, artificial or natural colors, tea, coffee, dairy products, or any combination thereof.

3. The method of claim 1, wherein said one or more second substances are selected from the group comprising: water, water, dehydrated substances, preservatives, preservative free substances, dietary supplement mixtures, nutritional mixtures, protein mixtures, dairy based proteins, milk proteins, whey proteins, vegetable based proteins, soy based proteins, amino-acids, beta alanine, vitamins, minerals, creatine, glutamine, L-arginine, phenylalanine, L-Leucine, L-Isoleucine, L-yaline, synephrine, yohimbe, ginseng, ascorbic acid, hydroxyl citric acid, aloe vera, dimethylamyamine, polysaccharide, monosaccharide, maltodextrin, dextrose, fructose, silicon, artificial sweeteners, natural sweeteners, sucralose, artificial or natural flavors, artificial or natural colors, tea, coffee, dairy products, or any combination thereof.

* * * * *